US011324291B2

(12) United States Patent
Moneta

(10) Patent No.: US 11,324,291 B2
(45) Date of Patent: May 10, 2022

(54) SLIDER FOR A SLIDE FASTENER

(71) Applicant: RIRI SA, Mendrisio (CH)

(72) Inventor: Alberto Moneta, Mendrisio (CH)

(73) Assignee: RIRI SA, Mendrisio (CH)

( * ) Notice: Subject to any disclaimer, the term of this patent is extended or adjusted under 35 U.S.C. 154(b) by 0 days.

(21) Appl. No.: 17/183,536

(22) Filed: Feb. 24, 2021

(65) Prior Publication Data

US 2021/0267324 A1 Sep. 2, 2021

(30) Foreign Application Priority Data

Feb. 28, 2020 (EP) ..... 20159983

(51) Int. Cl.
*A44B 19/30* (2006.01)

(52) U.S. Cl.
CPC ..... *A44B 19/303* (2013.01); *A44B 19/306* (2013.01)

(58) Field of Classification Search
CPC .... A44B 19/303; A44B 19/308; A44B 19/306
See application file for complete search history.

(56) References Cited

U.S. PATENT DOCUMENTS 2,358,726 A 9/1944 Marinsky
2,657,445 A * 11/1953 Weber ..... A44B 19/306 24/421
2,683,911 A * 7/1954 Backer ..... A44B 19/306 24/421
3,267,544 A * 8/1966 Davies ..... A44B 19/306 24/421
3,427,692 A * 2/1969 Rowlands ..... A44B 19/306 24/425
4,980,954 A * 1/1991 Takabatake ..... A44B 19/306 24/429
2010/0186200 A1* 7/2010 Chan ..... A44B 19/262 24/429
2017/0150789 A1* 6/2017 Lin ..... A44B 19/306

FOREIGN PATENT DOCUMENTS

BE 457049 A 9/1944
EP 2622983 A1 8/2013
EP 2752126 A1 7/2014

OTHER PUBLICATIONS

European Search Report issued in EP Patent Application No. EP 20159983.4, dated Aug. 24, 2020, pp. 1-5.

* cited by examiner

*Primary Examiner* — Robert Sandy
(74) *Attorney, Agent, or Firm* — Carter, DeLuca & Farrell LLP

(57) ABSTRACT

A slider for a slide fastener is disclosed having a slider body and a pull tab wherein: the slider body includes a pull tab retainer having a first side wall and a second side wall with respective recesses for accommodation of the ring of the pull tab, and each recess has a tongue which is inwardly extended to provide a contact surface for the ring, and each tongue joins with the respective side wall with a rounded edge.

15 Claims, 5 Drawing Sheets

SLIDER FOR A SLIDE FASTENER

CROSS REFERENCE TO RELATED APPLICATIONS

The present application claims the benefit of and priority to European Patent Application No. 20159983.4, filed Feb. 28, 2020, the entire contents of which is hereby incorporated by reference.

FIELD OF APPLICATION

The invention relates to the field of slide fasteners (zip fasteners). In particular the invention relates to a slider for a slide fastener.

BACKGROUND

A slide fastener comprises two tapes each provided with a row of interconnection elements, commonly named teeth, and a slider provided with a pull tab.

The slider comprises basically: an inner flange and an outer flange which define a meshing space for the interconnection elements; a bridge which extends above the outer flange and retains the pull tab. More particularly, the pull tab normally comprises a ring which is received between the outer flange of the slider and the bridge.

In a known embodiment, the bridge of the slider includes a cover element arranged to retain the pull tab. In some embodiments, the cover element performs the function of a resilient element for an automatic lock of the slider, in order to prevent undesired sliding. In a slider with this automatic lock feature, the cover can engage the interconnection elements of the zip fastener via a suitable opening of a flange, in such a way to prevent sliding of the fastener; the user action on the pull tab lifts the resilient element and temporarily disengages the lock.

According to the prior art, said cover element includes side walls with recesses arranged to accommodate the ring of the pull tab. Therefore, the ring of the pull tab is in direct contact with the side walls of the cover, particularly with the recesses thereof.

A drawback of this technique is that the cover element may be aggressive for the integrity of the pull tab, particularly of its ring. The cover element is normally made of metal by means of a shearing process, which is advantageous due to low cost and suitable for mass-production, but produces sharp edges of the recesses where the ring of the pull tab is accommodated. Said sharp edges may damage the pull tab producing visible scratches, which are highly undesirable especially for high-end sliders made of an expensive material and/or with a high-quality paint or surface finish.

SUMMARY OF THE INVENTION

The invention aims to solve the aforementioned problem. The invention aims in particular to solve the problem of how to prevent a visible damage of the pull tab and/or of the slider caused by friction between the pull tab and a pull tab retention cover of the slider.

The aim is reached with a slide fastener according to the claims. Some preferred features of the invention are stated in the dependent claims.

The slide fastener includes a pull tab retainer having a first side wall and a second side wall with recesses for accommodation of the ring of the pull tab.

Each recess has an inwardly extended tongue providing suitable contact surfaces for the ring of the pull tab and each of said first tongue and second tongue joins with the side wall of the pull tab retainer with a rounded edge.

The inwardly directed tongues provide safe and non-offensive rest surfaces for the ring of the pull tab. Particularly the rounded edges of transition between the side wall and the tongue provides a non-offensive contact with the ring and avoid its damage during the use due to relative displacement.

Said pull tab retainer may be a resilient element. In a preferred embodiment, the slider includes a releasable lock which is configured to prevent sliding and is releasable upon action of the user on the pull tab. In such a case, the pull tab retainer may be configured to act as a resilient element of said releasable lock. For example the retainer acts substantially as a spring of said releasable lock.

The recesses may be sized to limit the longitudinal displacement of the pull tab relative to the slider, in order to further reduce the risk of a damage caused by the friction between said two components.

The invention eliminates the sharp edges at the interface between the bridge of the slider and the ring of the pull tab. Accordingly the invention offers an improved accommodation for the pull tab and particularly for its ring, avoiding or reducing substantially the possibility of a reciprocal damage due to scratching.

DESCRIPTION OF PREFERRED EMBODIMENTS

The above-mentioned contact surfaces for the pull tab, which are defined by the inwardly extended tongues, are preferably planar.

In a preferred embodiment the first tongue is an integral part of the first side wall and the second tongue is an integral part of the second side wall. The retainer as a whole is preferably made integrally in a single piece. More preferably, the retainer is made with a molding process. Advantageously, by molding the retainer in a single piece, the first and second tongues can be integrally formed with the retainer itself.

The cover is made preferably of metal but a non-metal material may also be used.

The inwardly projected tongue of each side wall may project from the whole contour of the respective recess. Accordingly, the inwardly projected tongue of each recess may follow the contour of the respective recess.

In a preferred embodiment, said first recess and second recess are V-shaped or substantially V-shaped in order to define accommodation room for the ring of the pull tab. Alternative embodiments may include for example a U-shaped recess or a C-shaped recess or more generally a recess with a curvilinear shape or segmented shape.

In a preferred embodiment, a V-shaped recess includes two opposed inclined segments and a central segment between the inclined segments. The inclined segments may have the same or a different angle of inclination relative to a longitudinal direction of the retainer, e.g. a direction parallel to the sliding direction of the slider. More preferably the respective tongue projects from all the above segments thus following the contour of the V-shaped recess.

Preferably the sum of the projection of the first tongue and of the second tongue, from the inner face of the respective side wall of the retainer, is less than the distance between said inner faces of the side wall. Therefore the inner edges of the tongues remain spaced apart.

The first recess and the second recess may have a length such that a movement of the ring with respect to the slider body, in a longitudinal direction, is restrained to not more than a certain amount, for example not more than 1.5 mm and preferably not more than 1 mm. By limiting the freedom of movement of the pull tab relative to the retainer, the risk of a damage is further reduced.

The pull tab retainer may be configured as a cover element of the bridge.

The pull tab retainer may also be a resilient element. In some embodiments the retainer is basically a spring, e.g. a metal spring, of a releasable lock.

The slider may include a releasable lock configured to prevent sliding and is releasable upon action of the user on the pull tab, and the retainer may be configured to act as a resilient element of said releasable lock. More preferably, said retainer may have a rest position in which said lock is effective, and pulling the pull tab may cause the ring to lift the retainer from said rest position to release the lock and allow the sliding of the slider, wherein the ring can lift the resilient element and release the lock by means of contact with said insert and without a direct contact with the resilient element.

The invention is now described with reference to a preferred embodiment, by way of non-limitative example.

DETAILED DESCRIPTION

Figure 1:
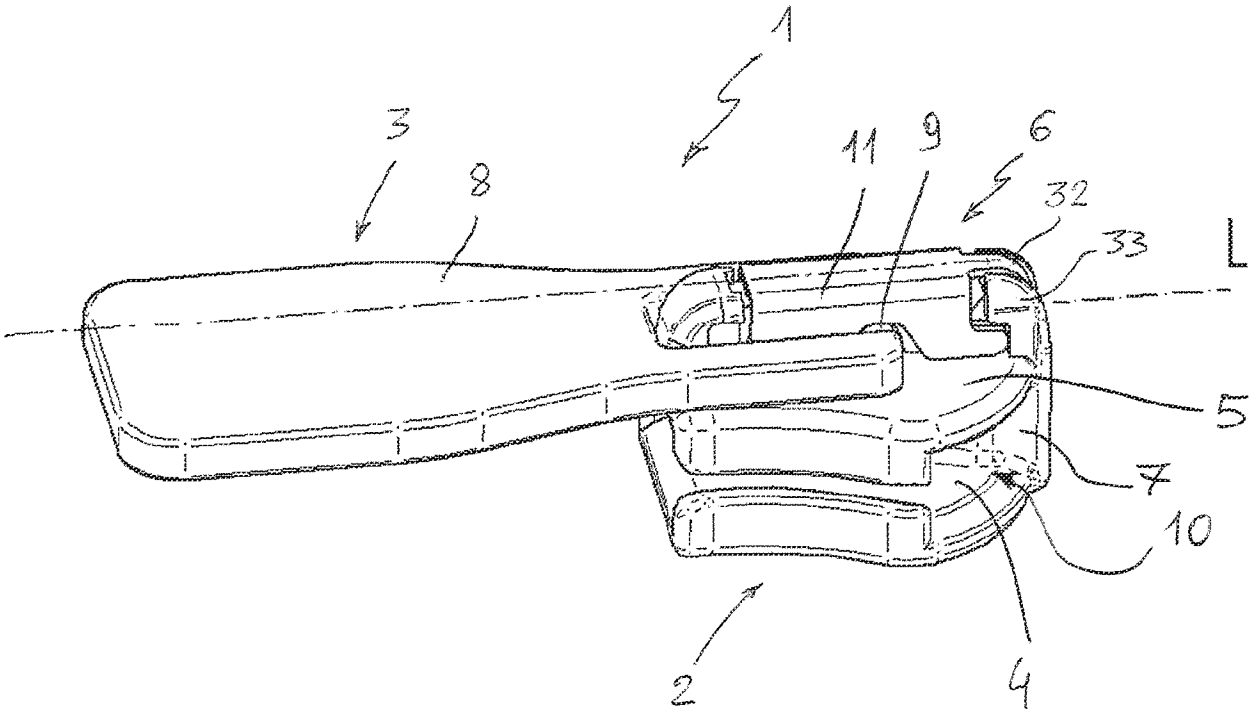
FIG. 1 is a perspective view of a slider for a slide fastener with pull tab according to an embodiment of the invention.
Figure 2:
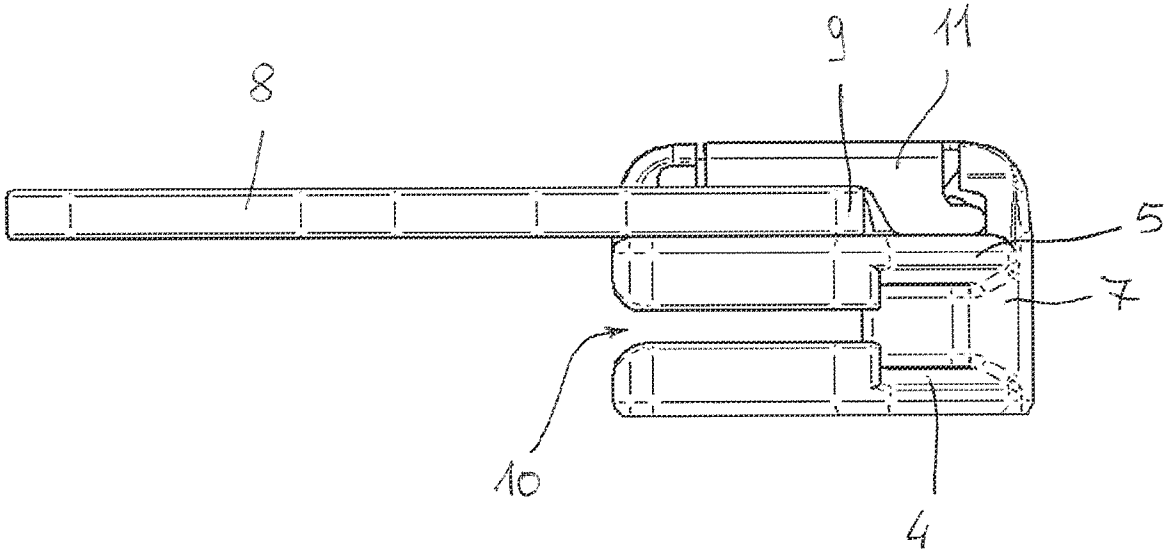
FIG. 2 is a side view of the slider of FIG. 1.

The figures illustrate an embodiment of a slider 1 including a slider body 2 and a pull tab 3.

The slider body 2 comprises an inner flange 4, an outer flange 5, a bridge 6, a core 7. The core 7 connects the flanges 4, 5 and is located in the front of the slider 1.

The pull tab 3 comprises a puller 8 and a ring 9.

The flanges 4 and 5 define a channel 10 for receiving and meshing of the interconnection elements of a zip fastener. FIG. 1 illustrates a direction L which is the sliding direction during the use and can be termed a longitudinal direction of the slider 1.

The bridge 6 includes a pull tab retainer which, in the exemplary embodiment of the figures, is a metal spring 11. The ring 9 of the pull tab 3 is retained between the outer flange 5 and the bridge 6. The upper surface of the outer flange 5 is preferably flat.

The spring 11 is a single piece of metal, made preferably by a molding process, including an upper plate 12, a first side wall 13 and a second side wall 14.

The first side wall 13 and a second side wall 14 project from the longitudinal edges of the upper plate 12 toward the outer flange 5. Accordingly the side walls 13, 14 are spaced apart and face one another. The cross section of the spring 11 has substantially the shape of an inverted U.

The first side wall 13 and the second side wall 14 have respectively a first V-shaped recess 15 and a second V-shaped recess 16 facing one another and arranged for receiving and retaining the pull tab ring 9.

Each of the two recesses 15, 16 has a respective inwardly projected tongue 17, 18 and bent at a suitable angle relative to the corresponding side wall. Accordingly, the first tongue 17 projects from the first side wall 13 toward the second side wall 14 and the second tongue 18 projects from the first side wall 14 toward the first side wall 13.

Said inwardly extended tongues 17, 18 form contact surfaces 19, 20 for the ring 9 of the pull tab. The first tongue 17 and second tongue 18 join with the respective side wall 13, 14 with a rounded edge 21, 22. The rounded edges 21, 22 provide therefore a smooth transition between the thin side walls 13, 14 of the spring 11 and the contact surfaces 19, 20.

Preferably the tongues 18, 19 are bent inwardly, relative to the side walls, by an angle of 90° or around 90°.

The contact surfaces 19, 20 are preferably planar.

Figure 5:
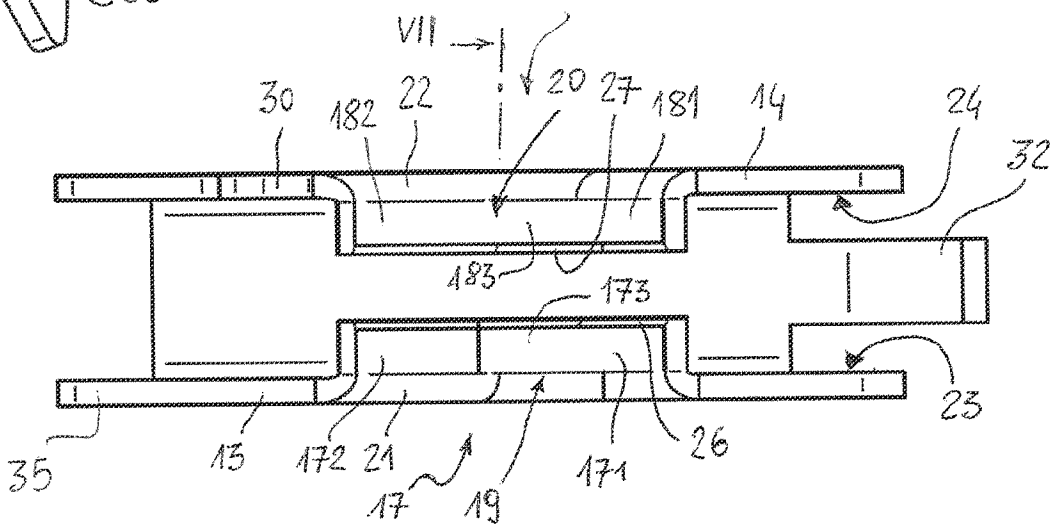
FIG. 5 is a bottom view of the retainer of FIG. 4.

As it can be seen in FIG. 5, the projection of the tongues 17, 18, from the inner faces 23, 24 of the side walls 13, 14, is less than the distance between said inner faces 23, 24 of the side walls, thus leaving a space 25 between the inner edges 26, 27 of the tongues 17, 18. In other words the tongues 17, 18 do not touch or overlap.

Figure 4:
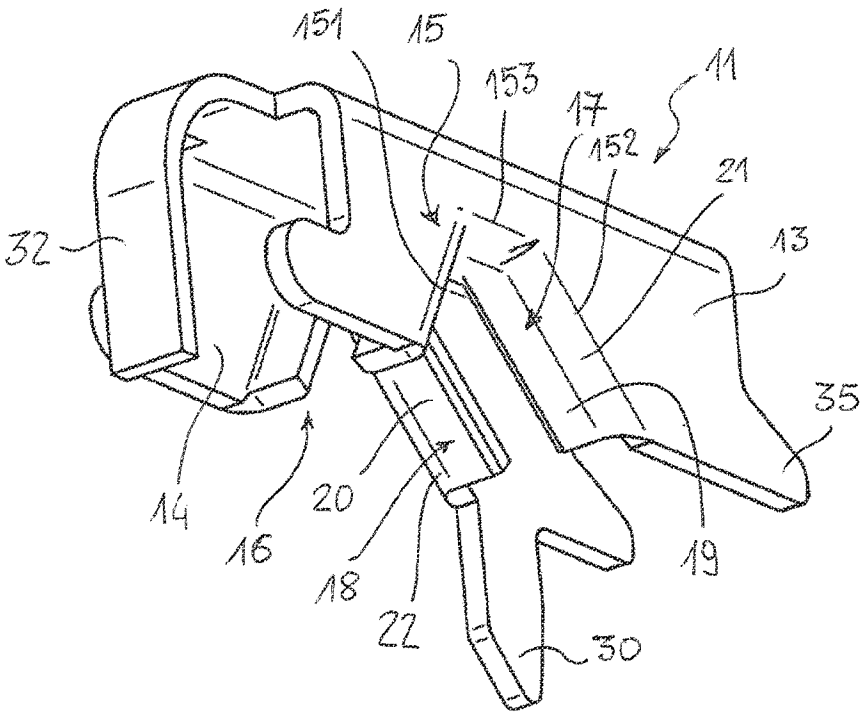
FIG. 4 is a view of the pull tab retainer of the slider of FIG. 1.
Figure 6:
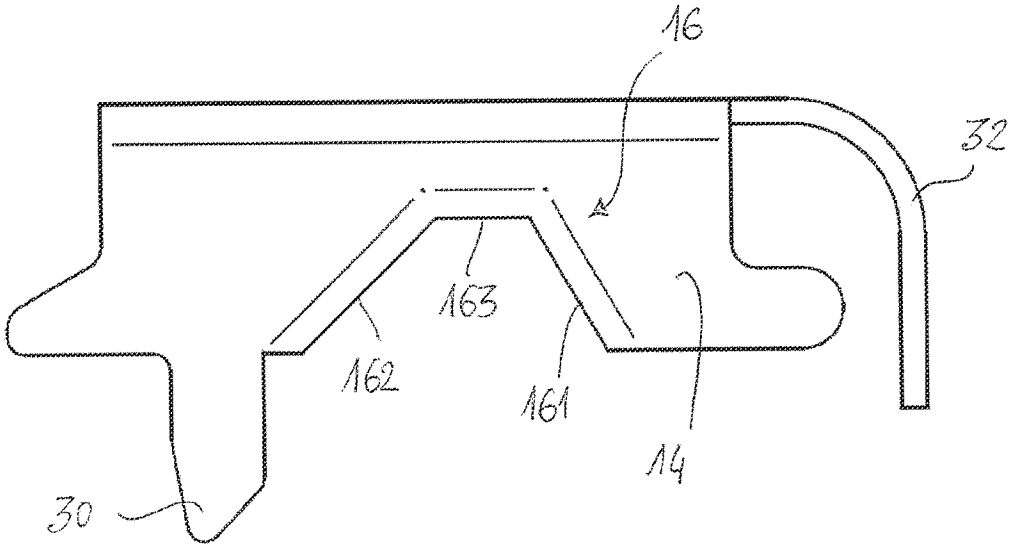
FIG. 6 is a side view of the retainer of FIG. 4.
Figure 7:
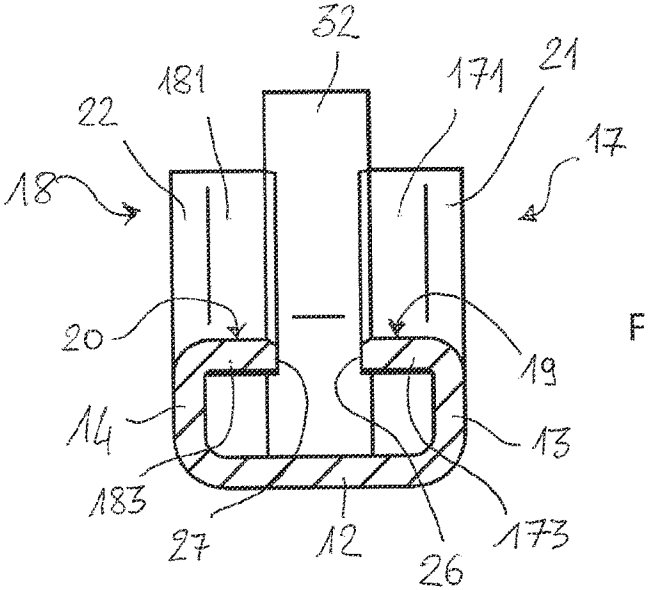
FIG. 7 is a cross section of the retainer according to plane VII of FIG. 5.

Each of the recesses 15, 16 is substantially V-shaped having two inclined segments extending from a base to a peak and connected by a third segment. For example the recess 15 has inclined segments 151 and 152 connected by a third segment 153 (FIG. 4). The recess 16 has preferably an identical shape including segments 161, 162 and 163 (FIG. 6).

The tongues 17, 18 and their rounded edges 21, 22 project preferably from the entire extension of the recesses. In the exemplary embodiment, each tongue comprises portions projecting form the inclined segments and from the central segment of the recesses. For example the tongue 17 comprises portions 171, 172 and 173 corresponding to segments 151, 152 and 153 of the recess 15 and the tongue 18 is similar in shape including portions 181, 182 and 183 projecting from the respective segments 161 to 163.

Also the contact surfaces 19, 20 have corresponding portions. Accordingly a contact surface may have a horizontal portion corresponding to segments 173, 183 and inclined portions corresponding to the inclined segments 171, 172 and 181, 182.

A length of a recess 15 or 16 can be taken along the direction L from opposite ends of the recess, for example between the bases of the opposed inclined segments 151, 152 and 161, 162 of the recesses 15, 16. Said length is preferably not greater than 1.5 mm and more preferably not greater than 1 mm to retain the ring 9 also in the longitudinal direction and prevent a back-and-forward movement of the pull tab relative to the slider body.

The spring 11 is preferably part of a releasable locking system arranged to prevent undesired sliding of the slider, e.g. undesired opening of the zip fastener.

Said locking system is known in itself and basically provides that the spring has a rest position in which said lock is activated and sliding is prevented. Lifting the pull tab causes the ring to lift the spring and release the lock.

Figure 3:
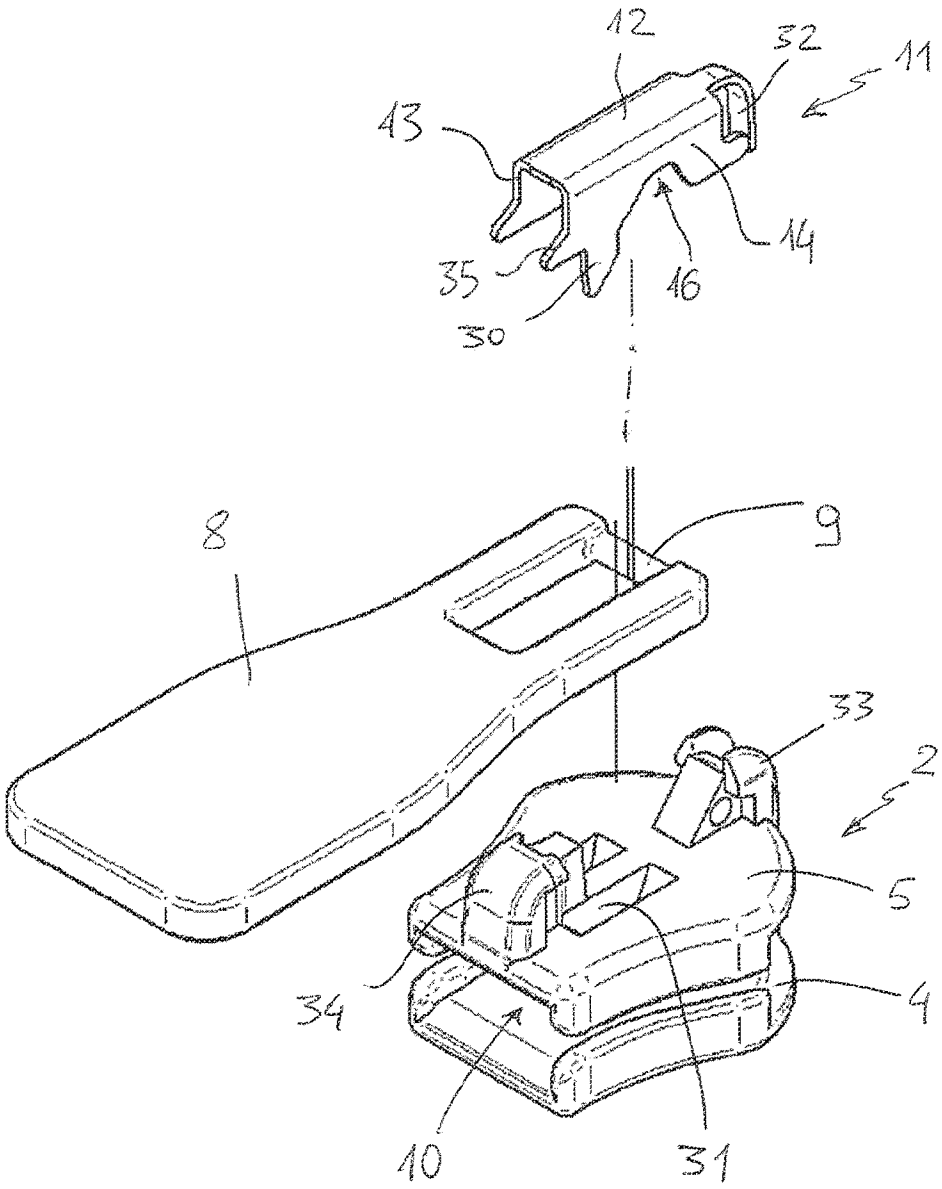
FIG. 3 is an exploded view of the slider of FIG. 1.

To this purpose, in the illustrated embodiment the spring 11 has a tooth 30 positioned to enter a slot 31 of the outer flange 5 (FIG. 3). When inserted in the window 31, said tooth 30 protrudes in the channel 10 and is able to engage the teeth of the slide fastener to prevent sliding. By lifting the spring 11, the tooth 30 is extracted from the channel 10 and the lock is disengaged.

The spring 11 has also a front tongue 32 for attachment to a front head 33 of the slider body 2. Opposite the front head 33, the slider body 6 includes a support 34. The retainer spring 11 is fitted between the head 33 and the support 34. Opposite to the front tongue 32, the spring 11 has two legs 35 for insertion into suitable slots of the support 34.

In use, the ring 9 rests on the surface of the flange 5 and on the contact faces 19, 20 of the recesses. Particularly when the pull tab is pulled for operation, the ring 9 normally abuts against said contact faces 19, 20, either the central parts or the inclined portions.

The smooth surface of said faces 19, 20, particularly thanks to the rounded edges 21, 22 of connection with the side walls, prevents the ring 9 from damage. In any case the ring 9 always finds a smooth and rounded surface without sharp edges.

The invention claimed is:

1. A slider for a slide fastener comprising a slider body and a pull tab wherein:

the slider body comprises an inner flange, an outer flange and a bridge above the outer flange;

the pull tab comprises a ring which is retained between said outer flange and said bridge;

the bridge includes a pull tab retainer having a first side wall and a second side wall, said first side wall and second side wall being distanced and facing one another, and projecting toward the outer flange;

the first side wall has a first recess and the second side wall has a second recess, the first recess and second recess facing one another and being arranged for receiving and retaining the ring of the pull tab;

each of said first recess and second recess having an inwardly extended tongue, so that a first tongue of the first side wall projects toward the second side wall and a second tongue of the second side wall projects toward the first side wall;

the first tongue and the second tongue providing contact surfaces for the ring of the pull tab;

each of said first tongue and second tongue joining with the respective side wall with a rounded edge.

2. The slider according to claim 1, wherein said contact surfaces are planar or substantially planar.

3. The slider according to claim 1, wherein the first tongue is an integral part of the first side wall and the second tongue is an integral part of the second side wall.

4. The slider according to claim 1, wherein the pull tab retainer is integrally made in a single piece.

5. The slider according to claim 4, wherein the pull tab retainer is made with a molding process.

6. The slider according to claim 1, wherein the pull tab retainer is made of metal.

7. The slider according to claim 1, wherein the tongue of each side wall and the respective rounded edge project from the entire contour of the respective recess.

8. The slider according to claim 1, wherein the first recess and the second recess are V-shaped or substantially V-shaped.

9. The slider according to claim 8, wherein each of the first recess and second recess includes two opposed inclined segments and a central segment between the inclined segments, and each tongue has corresponding portions which project from all the segments of the recess thus following the contour of the recess.

10. The slider according to claim 1, wherein a sum of the projection of the first tongue and of the second tongue is less than the distance between inner faces of the first side wall and second side wall, so that inner edges of the tongues remain spaced apart.

11. The slider according to claim 1, wherein the first recess and the second recess have a length such that a movement of the ring with respect to the slider body, in a longitudinal direction, is restrained to not more than 1.5 mm.

12. The slider according to claim 1, wherein the retainer is a resilient element.

13. The slider according to claim 12, wherein the slider includes a releasable lock configured to prevent sliding and is releasable upon action of a user on the pull tab, and the pull tab retainer is configured to act as a resilient element of the releasable lock.

14. The slider according to claim 13, wherein: the pull tab retainer has a rest position in which the lock is effective, and pulling the pull tab causes the ring to lift the resilient element from the rest position to release the lock and allow the sliding of the slider, wherein the ring can lift the resilient element and release the lock.

15. The slider according to claim 1, wherein the first recess and the second recess have a length such that a movement of the ring with respect to the slider body, in a longitudinal direction, is restrained to not more than 1 mm.

* * * * *